US006382733B1

(12) United States Patent
Parrott

(10) Patent No.: US 6,382,733 B1
(45) Date of Patent: May 7, 2002

(54) HYDRAULICALLY EJECTABLE MINERAL CUTTING APPARATUS

(75) Inventor: George Albert Parrott, Barnsley (GB)

(73) Assignee: Minnovation Limited (GB)

( * ) Notice: Subject to any disclaimer, the term of this patent is extended or adjusted under 35 U.S.C. 154(b) by 0 days.

(21) Appl. No.: 09/623,238

(22) PCT Filed: Mar. 2, 1999

(86) PCT No.: PCT/GB99/00619

§ 371 Date: Aug. 29, 2000

§ 102(e) Date: Aug. 29, 2000

(87) PCT Pub. No.: WO99/45238

PCT Pub. Date: Sep. 10, 1999

(30) Foreign Application Priority Data

Mar. 3, 1998 (GB) ..... 9804413

(51) Int. Cl.[7] ..... E21C 35/19
(52) U.S. Cl. ..... 299/106; 299/104
(58) Field of Search ..... 299/106, 102, 299/104, 79.1

(56) References Cited

U.S. PATENT DOCUMENTS 3,143,177 A 8/1964 Galoreau et al.
4,337,980 A 7/1982 Krekeler
5,106,166 A * 4/1992 O'Neill ..... 299/102
5,302,005 A 4/1994 O'Neill
5,498,069 A * 3/1996 Siebenhofer et al. ..... 299/81.3
5,725,283 A 3/1998 O'Neill
5,884,979 A * 3/1999 Latham ..... 299/106
6,176,552 B1 * 1/2001 Topka, Jr. et al. ..... 299/104

FOREIGN PATENT DOCUMENTS

GB 2285464 A * 7/1995
WO WO-98/39553 * 8/1998

* cited by examiner

*Primary Examiner*—David Bagnell
*Assistant Examiner*—John Kreck
(74) *Attorney, Agent, or Firm*—Trexler, Bushnell, Giangiorgi, Blackstone & Marr Ltd.

(57) ABSTRACT

A mounting member (1), for a mineral cutting apparatus (2), has an enlarged head (3) incorporating an annular seating shoulder (4), whilst a circular section pin (5) extends integrally from the head (3) and is adapted to be received in a circular section socket (11) of a pick box (12) and to be retained therein, a circumferential groove (16) being provided intermediate the ends of the pins (5) to receive a fluid sealing member (17), with a first portion (24) of the pin (5) being of such diameter that, in use, it is a slide fit within a pick box socket (11), and with a second portion (25) of the pin (5), being of such diameter that, in use, it is an interference fit within a a pick box socket (11). The invention also includes a pick box; a mounting member and a pick box combination; a drum for a mineral cutting apparatus; mineral cutting apparatus; a road planing machine; a mining machine, and a tunnelling machine.

30 Claims, 5 Drawing Sheets

HYDRAULICALLY EJECTABLE MINERAL CUTTING APPARATUS

FIELD OF THE INVENTION

This invention relates to mineral cutting apparatus, and in particular to a mounting member and a pick box for a cutter pick, for road planing apparatus or of mining or tunnelling machines.

BACKGROUND OF THE INVENTION

Both road planing apparatus and a continuous mining machine comprise, respectively, a self-propelled wheeled or tracked chassis carrying a power driven drum. To the periphery of the drum is welded an array of pick boxes, each to receive a replaceable pick, usually having a tungsten carbide tip, possibly with a replaceable sleeve between the pick and the box.

Frequently, through poor practice, a lost or worn pick is not noticed or is ignore, resulting in wear and/or damage to the box. The worn box must be removed and a replacement box welded in place. Furthermore, the replaceable component(s), whether in the form of a pick or a sleeve, is replaceably secured by a compromise between a system that prevents inadvertent loss at unacceptable levels, yet one that permits on-site removal and replacement without too much difficulty.

OBJECT OF THE INVENTION

A basic object of the invention is the provision of improved mineral cutting apparatus etc.

SUMMARY OF A FIRST ASPECT OF THE INVENTION

According to a first aspect of the present invention, there is provided a mounting member for a pick, for a mineral cutting apparatus, the member having:

(i) an enlarged head incorporating an annular seating shoulder;

(ii) a circular section pin extending integrally from the head and adapted to be received in a circular section socket of a pick box and to be retained therein;

(iii) a circumferential groove intermediate the ends of the pin to receive a fluid sealing member, (iv) a first portion of the pin beyond the circumferential groove, remote from the head, being of such diameter that, in use, it is a slide fit within a pick box socket, and (v) a second portion of the pin, between the groove and the head being of such diameter that, in use, it is an interference fit within a pick box socket.

In one embodiment, the enlarged head of the mounting member may be provided with an aperture appropriate to receive a shank of a mineral cutter pick, which shank aperture, for an asymmetrical mounting member is not coaxial with the longitudinal axis of the mounting member pin, but for a symmetrical mounting member ie a sleeve, is coaxial with the longitudinal axis of the mounting member pin.

In a second embodiment a block provided with a pick shank aperture may be welded to the enlarged head of the mounting member, preferably at a non-orthogonal angle (eg 20–25°, preferably 24.5°) to the longitudinal axis of the mounting member, so that if a pick is lost or damaged, resulting in damage to the enlarged head, the entire mounting member need not necessarily be scrapped, as there is the possibility of burning off the damaged portion and welding on a replacement portion, with attendant cost savings.

With an asymmetrical mounting member this is also provided with a location means to determine the orientation of the mounting member with respect to the pick box on which it is to be mounted. The locating means may take the form of a pin and hole arrangement. Thus, in detail a blind hole parallel to, but offset from, the longitudinal axis, may be drilled into the base of the pick to be engaged by an orientation pin of the pick box on which the mounting member is to be fitted.

Of whatever form, the mounting member or block is also preferably provided with an abutment surface extending orthogonally, or generally so, with respect to the longitudinal axis of the mounting member pin, whereby after the slide-fit, first portion of the mounting member pin has been fitted into the receiving aperture the interference fit, second portion may be forced in by hammering on the abutment surface.

Preferably, the seating shoulder extends radially. Preferably, the fluid sealing member is a resilient "O"-ring located in the circumferential groove engageable, in use, with a portion of the internal periphery of the pick box socket.

With an asymmetrical mounting member, its aperture to receive a pick shank is preferably so located that the end of the shank is accessible, so that a worn or damaged pick may be hammered out of its aperture.

SUMMARY OF A SECOND ASPECT OF THE INVENTION

According to a second aspect of the invention, there is provided a pick box adapted to be welded to the external periphery of a drum for a mineral cutting apparatus comprising:

(i) a blind circular socket adapted, in use, to receive and to retain as an interference fit a circular section pin of a replaceable mounting member, and (ii) a bore communicating between the external periphery of the box and a portion of the socket.

whereby fluid such as grease or oil, introduced under pressure via the bore, serves to displace the pin from its aperture, when changing of a worn or damaged replaceable member is required.

At the external periphery of the box, the bore may be tapped to a receive a screw-in plug, which is removeable so that a connector fitting from a source of pressurised oil or grease, may be screwed in. Preferably however, a grease nipple is screwed into the tapped bore, eg by providing the grease nipple with a threaded spigot. Preferably, the box is provided with a recess in which the nipple can be accommodated so that it does not stand proud and hence is not prone to damage. The portion of the socket in communication with the bore, is preferably the bottom of the socket.

As the drum of a road planing machine for instance is conventionally provided with a spiral vane to assist in conveying spoil eg to a pick-up conveyor which may be located centrally of the machine, whereby vanes to opposite sides of the conveyor may be oppositely handed, preferably two selectable location means eg holes, are provided, with the appropriate location means selected for the handing of the vane. In detail, two spaced blind holes may be drilled into the base of the blind socket with a selected hole receiving one end of an orientation pin eg a roll pin.

According to a third aspect there is provided, in combination, a mounting member in accordance with the first aspect, mounted on a pick box in accordance with the second aspect.

Thus, the mounting member in accordance with the first aspect, pick box in accordance with the second, and combination in accordance with the third, provide the advantages that the mounting member may be hammered home into the pick box with the interference fit ensuring that the element cannot inadvertently be pulled from its box and lost eg when the direction of rotation of the drum is reversed, while the provision of an hydrauiic means of release and displacement ensures that, despite a tight interference fit, easy removal is ensured eg by applying a grease gun to the nipple.

BRIEF DESCRIPTION OF THE DRAWINGS

Three embodiments of element, pick box and combination is shown in the accompanying drawings, in which.

DETAILED DESCRIPTION OF THE DRAWINGS

Figure 1:
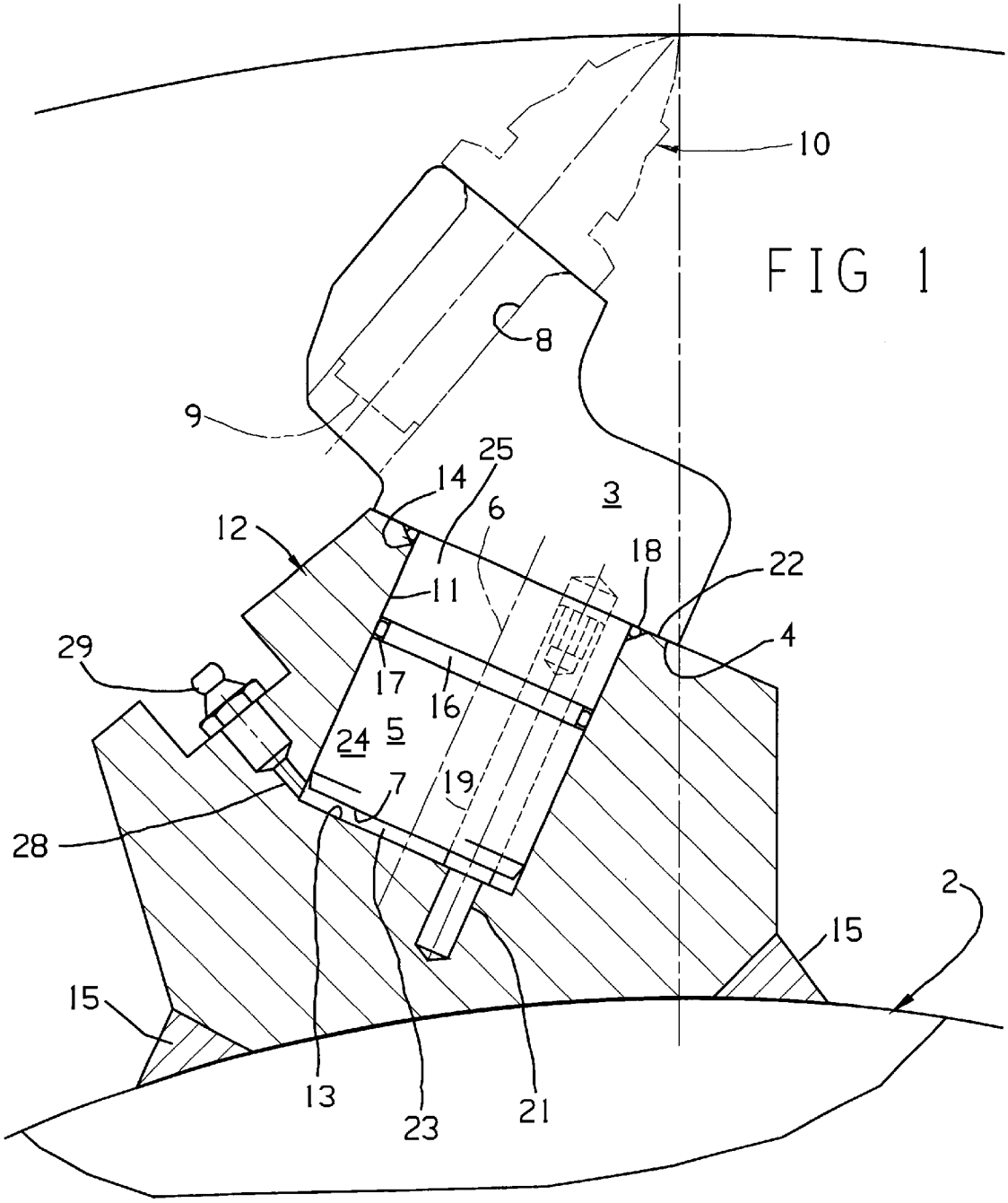
FIGS. 1 and 2 are, respectively, a part-sectional side elevation, and a view on the base of the socket, of a first embodiment.

In all FIGS., like components are accorded like reference numerals.

A mounting member 1 for a mineral cutting apparatus 2 has an enlarged head 3 incorporating an annular seating shoulder 4, whilst a circular section pin 5, having a longitudinal axis 6 extends integrally from the head 3 and terminates in an orthogonal end surface 7. The head 3 is provided with an aperture 8 to receive a shank 9 of an industry-standard mineral cutting pick 10.

The pin 5 is adapted to be received in a circular section socket 11 of a pick box 12 and to be retained therein solely by friction, the socket 11 terminating in a base 13 and at its other end being provided with an annular chamfered surface 14. The pick box 12 is secured by weld metal 15 to the mineral cutting apparatus 2, specifically to the periphery of a drum of a rotary cutting head or to a helical vane of such a head.

A circumferential groove 16 is provided intermediate the ends of the pin 5 to receive a resilient sealing ring 17 to engage the socket 11 in a fluid tight manner, whilst a second resilient, fluid sealing ring 18 is located on the pin 5 adjacent the seating shoulder 4 to engage the chamfered surface 14 when the pin 5 is fully engaged in the socket 11, whilst a blind hole 19 offset from the longitudinal axis 6 of the pin 5 is drilled into the pin 5 from the end surface 7.

A pair of spaced-apart, blind holes 20 (see FIG. 2) are drilled into the base 13 of the socket 11 and into one selected hole 20 is fitted a screw-in pin 21 (FIG. 1) or a knock-in roll pin 21A (FIGS. 3, 4 and 5A to 5C) of diameter approximating to that of the hole 19 of the pin 5, and of length such that the hole 19 may be engaged over the roll pin 21, as indicated in FIG. 1, so as to fix the orientation of the mounting member 1, and hence the cutter pick 10, with respect to the pick box 12.

The length of the pin 5 is slightly less than that of the socket 11 such that when the shoulder 4 engages a seating surface 22 of the pick box, a chamber 23 is defined between the end surface 7 of the pin 5 and the base 13 of the socket 11.

Figure 5A:
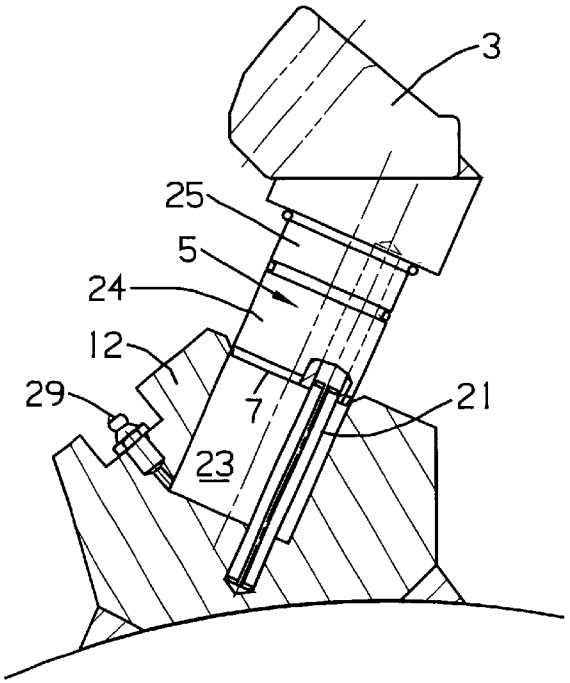
FIGS. 5A, 5B and 5C show three steps involved in inserting a mounting member in accordance with the first aspect of the invention and as depicted in FIG. 3 being fitted out a pick box in accordance with the second aspect of the invention.
Figure 5B:
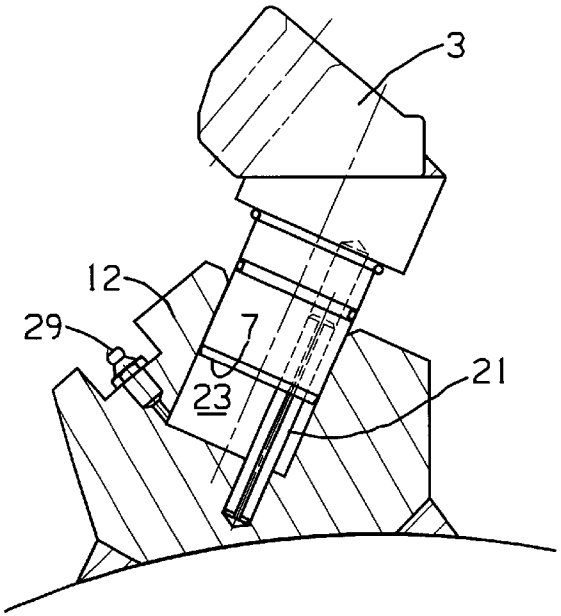
Figure 5C:
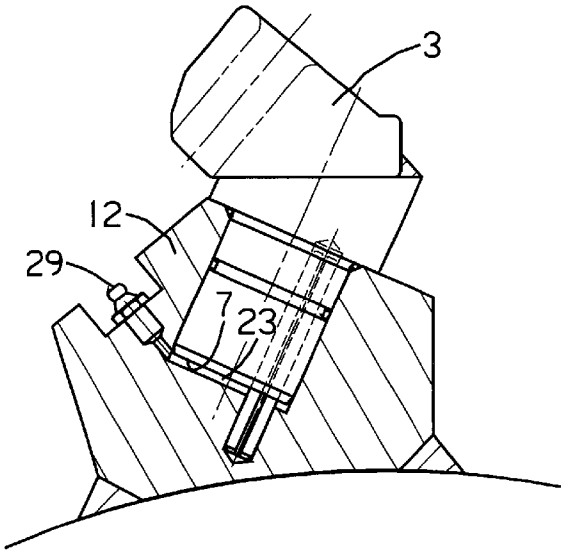

Finally, a first portion 24 of the pin 5, which portion extends from the end surface 7 to the circumferential groove 16, is of such diameter that it is a slide fit within the socket 11, whilst a second portion 25 of the pin 5, which portion extends from the circumferential groove 16 to the shoulder 4, is an interference fit within the socket 11 so that, as illustrated in FIGS. 5A, 5B and 5C, firstly the end surface 7 is first presented to the mouth of the socket 11 and an upper end 26 of the roll pin 21 engaged in the blind hole 19, secondly the slide fit portion 24 of the pin 5 is pushed, by hand, into the socket 11, and finally the interference fit portion 25 is forced into the socket 11 by hammering on, e.g. surface 27 of the mounting member 1.

Whilst, in use, it is only normally necessary to replace the cutter pick 10, it is sometimes the case that a lost, broken-off, or excessively worn pick 10 is not observed, resulting in damage to the mounting member 1, requiring removal of the mounting member 1 from the pick box.

In accordance with the invention this is achieved by providing the pick box 12 with a bore 28 in fluid flow communication with the chamber 23 and providing a nipple 29 at the end of the bore 28, preferably located in a recess 30 to minimise damage to the nipple 29. A source of high pressure fluid, e.g. water, a water oil emulsion or grease, is then applied to the nipple 29 via a hydraulic hose, if available, or a grease gun, whereby pin 5 of the mounting member 1 is hydraulically jacked out of aperture 11 of the pick box 12.

Figure 2:
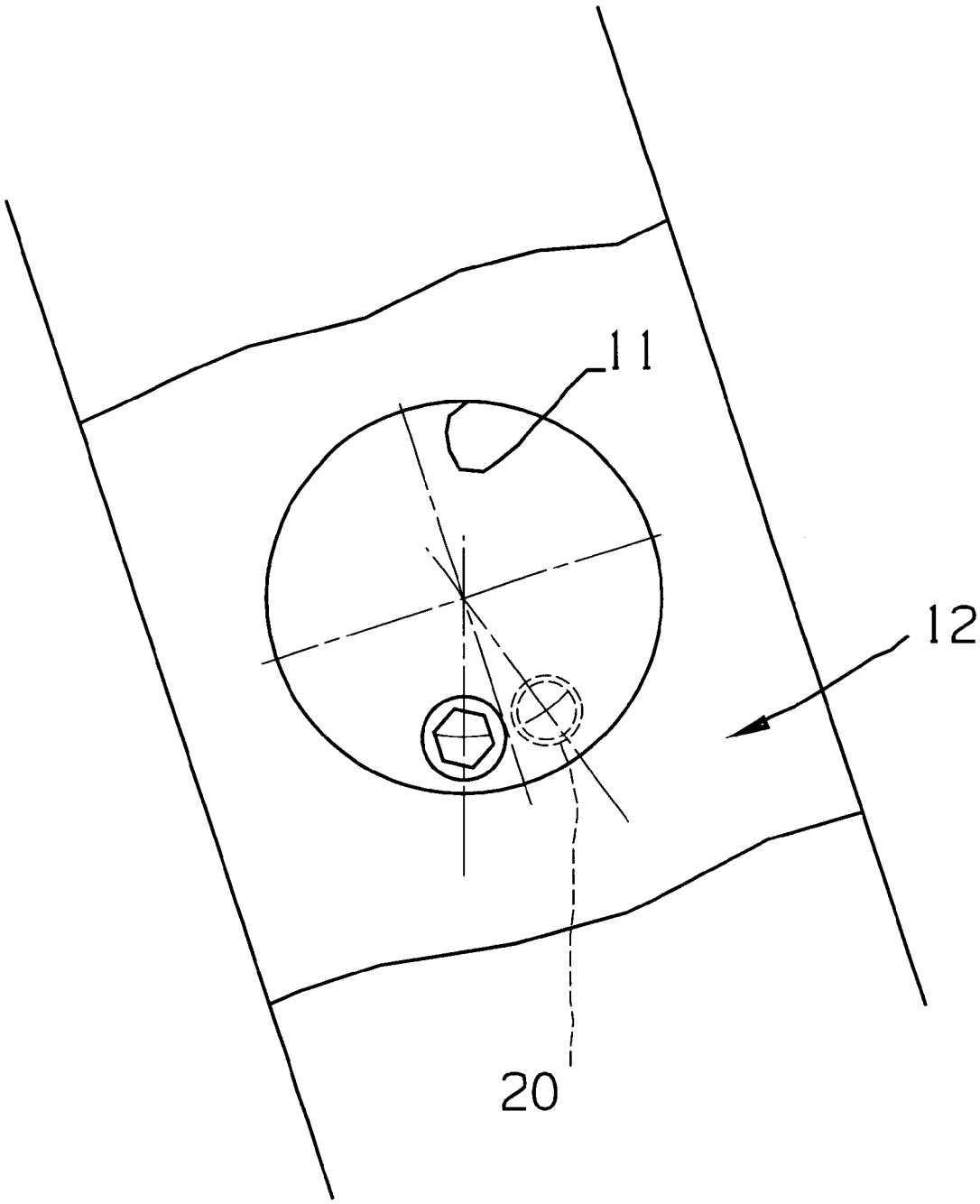
Figure 3:
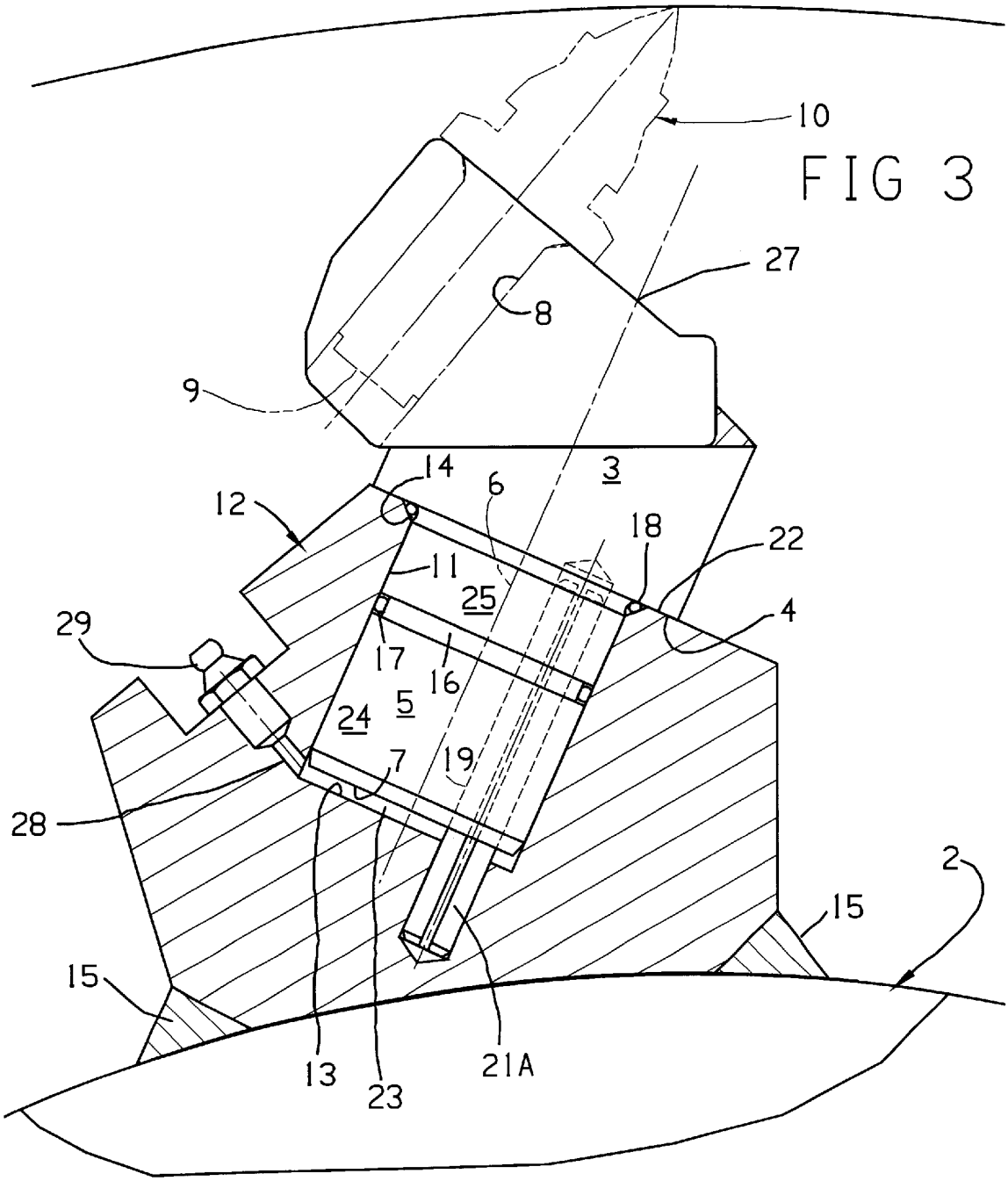
FIG. 3 corresponds to FIG. 1 but shows a second embodiment.

In the embodiment of FIGS. 1 and 2, the enlarged head 3 of the mounting member is a one piece element. In the embodiment of FIG. 3, the enlarged head 3 is formed by two components being a block 31 secured by weld metal 32 to the enlarged head 3.

Figure 4:
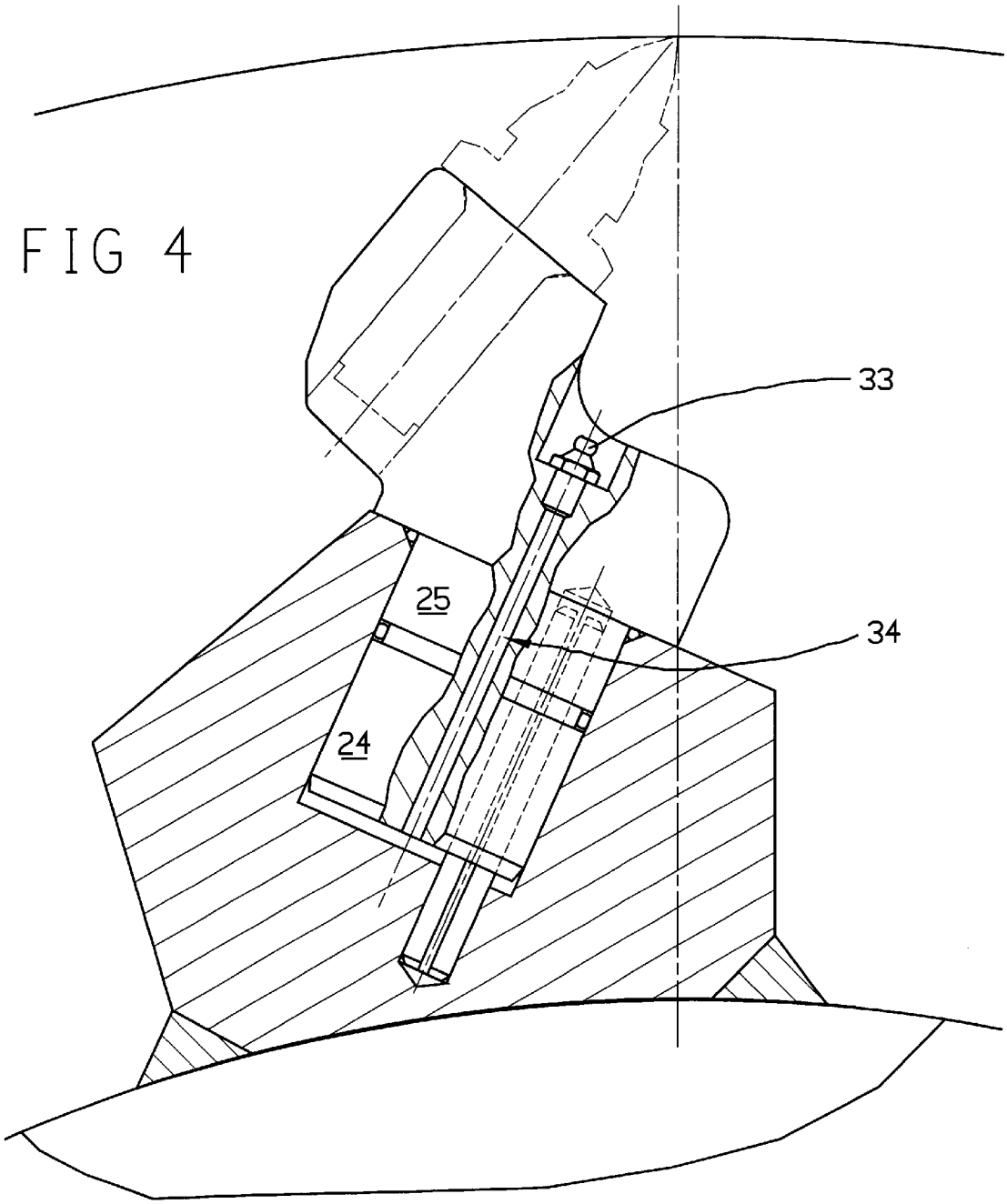
FIG. 4 corresponds to FIG. 1 but shows a third embodiment.

As indicated in FIG. 4, instead of the pick box 12 being provided with a nipple 29 and a bore 28, the enlarged head may be provided with a nipple 33, with pressure fluid or grease conveyed to the chamber 23 by a bore 34.

What is claimed is:

1. A mounting member, for a mineral cutting apparatus, said mounting member having:

(i) an enlarged head incorporating an annular seating shoulder, (ii) a circular section solid pin extending integrally from said head and adapted, in use, to be received in a circular section socket of a pick box and to be retained therein, (iii) a circumferential groove intermediate opposite ends of said pin to receive a fluid sealing member, (iv) a base of said pin remote from said enlarged head presenting a circular face to which fluid pressure may be applied to extract said pin from its receiving socket, (v) a first portion of said pin beyond said circumferential groove, remote from said head, being of such diameter that, in use, it is a slide fit within a pick box socket, and (vi) a second portion of said pin, between said groove and said head being of such diameter that, in use, it is an interference fit within a pick box socket.

2. A mounting member as claimed in claim 1, wherein said enlarged head is provided with an aperture appropriate to receive a shank of a mineral cutter pick.

3. A mounting member as claimed in claim 2, wherein said aperture in not coaxial with a longitudinal axis of said pin of said mounting member.

4. A mounting member as claimed in claim 2, wherein said mounting member is also provided with a location means to determine the orientation of said mounting member with respect to the pick box on which, in use, it is to be mounted.

5. A mounting member as claimed in claim 4, wherein said locating means takes the form of a pin and hole arrangement.

6. A mounting member as claimed in claim 2, wherein said aperture to receive said pick shank is so located that an end of said shank is accessible, so that a worn or damaged pick may be hammered out of its said aperture.

7. A mounting member as claimed in claim 1, wherein a block provided with a pick shank aperture is welded to said enlarged head of said mounting member.

8. A mounting member as claimed in claim 7, wherein said block is welded at a non-orthogonal angle to a longitudinal axis of said pin of said mounting member.

9. A mounting member as claimed in claim 1 provided with an abutment surface extending orthogonally, or generally so, with respect to a longitudinal axis of said pin of said mounting member, whereby after said slide-fit, first portion of said pin of said mounting member has been fitted into said pick box socket, said interface fit, second portion may be forced in by hammering on said abutment surface.

10. A mounting member as claimed in claim 1, wherein said seating shoulder of said enlarged head extends radially.

11. A mounting member as claimed in claim 1, wherein said fluid sealing member is a resilient "O" ring located in said circumferential groove engageable, in use, with a portion of the internal periphery of said pick box socket.

12. A drum for mineral cutting apparatus provided with a plurality of mounting members as defined in any of claims 1–11.

13. A mounting member as claimed in claim 8, wherein said non-orthogonal angle is between 20–25°.

14. A mounting member as claimed in claim 8, wherein said non-orthogonal angle is 24.5°.

15. A pick box adapted to be welded to an external periphery of a drum for a mineral cutting apparatus comprising:

(i) a blind circular socket adapted, in use, to receive and to retain as an interference fit a circular section pin of a replaceable mounting member, and (ii) a bore communicating between the external periphery of said pick box and a portion of said blind socket, whereby fluid such as grease or oil, introduced under pressure via said bore, serves to displace said pin from its socket, when the changing of a worn or damaged replaceable mounting member is required; and further comprising two selectable location holes.

16. A pick box as claimed in claim 15, wherein two spaced blind holes are drilled into the base of the blind socket with a selected hole receiving one end of an orientation pin.

17. A drum for mineral cutting apparatus provided with a plurality of pick boxes as defined in claim 15 or claim 16.

18. A combination comprising: a mounting member for a mineral cutting apparatus including:

(i) an enlarged head incorporating an annular seating shoulder, (ii) a circular section solid pin extending integrally from said head and adapted, in use, to be received in a circular section socket of a pick box and to be retained therein, (iii) a circumferential groove intermediate opposite ends of said pin to receive a fluid sealing member, (iv) a base of said pin remote from said enlarged head presenting a circular face to which fluid pressure may be applied to extract said pin from its receiving socket, (v) a first portion of said pin beyond said circumferential groove, remote from said head, being of such diameter that, in use, it is a slide fit within a pick box socket, and (vi) a second portion of said pin, between said groove and said head being of such diameter that, in use, it is an interference fit within a pick box socket; and a pick box adapted to be welded to an external periphery of a drum for the mineral cutting apparatus, said pick box comprising:

(i) a blind circular socket adapted, in use, to receive and to retain as an interference fit a circular section pin of a replaceable mounting member, and (ii) a bore communicating between the external periphery of said pick box and a portion of said blind socket, whereby fluid such as grease or oil, introduced under pressure via said bore, serves to displace said pin from its socket, when the changing of a worn or damaged replaceable mounting member is required.

19. A mineral cutting apparatus comprising:

a drum having a plurality of mounting members, each said mounting member comprising:

(i) an enlarged head incorporating an annular seating shoulder, (ii) a circular section solid pin extending integrally from said head and adapted to be received in a circular section socket of a pick box and to be retained therein, (iii) a circumferential groove intermediate opposite ends of said pin to receive a fluid sealing member, (iv) a base of said pin remote from said enlarged head presenting a circular face to which fluid pressure may be applied to extract said pin from its receiving socket;

(v) a first portion of said pin beyond said circumferential groove, remote from said head, being of such diameter that, in use, it is a slide fit within a pick box socket, and (vi) a second portion of said pin, between said groove and said head being of such diameter that, in use, it is an interference fit within a pick box socket.

20. A mineral cutting apparatus as defined in claim 19, wherein said mineral cutting apparatus is a road planning machine.

21. A mineral cutting apparatus as defined in claim 19, wherein said mineral cutting apparatus is a mining machine.

22. A mineral cutting apparatus as defined in claim 19, wherein said mineral cutting apparatus is a tunneling machine.

23. A mounting member, for a mineral cutting apparatus, said mounting member comprising:

(i) an enlarged head incorporating an annular seating shoulder, said enlarged head being provided with an aperture appropriate to receive a shank of a mineral cutter pick.

(ii) a circular section pin extending integrally from said head and adapted, in use, to be received in a circular section socket of a pick box and to be retained therein, (iii) a circumferential groove intermediate opposite ends of said pin to receive a fluid sealing member, (vi) a first portion of said pin beyond said circumferential groove, remote from said head, being of such diameter that, in use, it is a slide fit within a pick box socket, (v) a second portion of said pin, between said groove and said head being of such diameter that, in use, it is an interference fit within a pick box socket, and wherein said aperture is not coaxial with a longitudinal axis of said pin of said mounting member.

24. A drum for mineral cutting apparatus provided with a plurality of mounting members as defined in claim 23.

25. A mounting member for a mineral cutting apparatus, said mounting member comprising:

(i) an enlarged head incorporating an annular seating shoulder, (ii) a circular section pin extending integrally from said head and adapted, in use, to be received in a circular section socket of a pick box and to be retained therein, (iii) a circumferential groove intermediate opposite ends of said pin to receive a fluid sealing member, (vi) a first portion of said pin beyond said circumferential groove, remote from said head, being of such diameter that, in use, it is a slide fit within a pick box socket, (v) a second portion of said pin, between said groove and said head being of such diameter that, in use, it is an interference fit within a pick box socket, and wherein a block provided with a pick shank aperture is welded to said enlarged head of said mounting member.

26. A drum for mineral cutting apparatus provided with a plurality of mounting members as defined in claim 25.

27. A mounting member as claimed in claim 25, wherein said block is welded at a non-orthogonal angle to a longitudinal axis of said pin of said mounting member.

28. A drum for mineral cutting apparatus provided with a plurality of mounting members as defined in claim 27.

29. A pick box adapted to be welded to an external periphery of a drum for a mineral cutting apparatus comprising:

(i) a blind circular socket adapted, in use, to receive and to retain as an interference fit a circular section pin of a replaceable mounting member, (ii) a bore communicating between the external periphery of said pick box and a portion of said blind socket, and (iii) two selectable location holes, whereby fluid such as grease or oil, introduced under pressure via said bore, serves to displace said pin from its socket, when the changing of a worn or damaged replaceable mounting member is required and wherein two spaced blind holes are drilled into the base of the blind socket with a selected hole receiving one end of an orientation pin.

30. A drum for mineral cutting apparatus provided with a plurality of pick boxes as defined in claim 29.

* * * * *